US005564136A

United States Patent [19]

Cox

[11] Patent Number: 5,564,136

[45] Date of Patent: Oct. 15, 1996

[54] INCONTINENCE SEAT FOR A WHEELCHAIR

[76] Inventor: Kathleen M. Cox, 17736 Larkspur La., Homewood, Ill. 60430

[21] Appl. No.: 456,553

[22] Filed: Jun. 1, 1995

[51] Int. Cl.[6] ..... A47K 11/06

[52] U.S. Cl. ..... 4/480; 4/484

[58] Field of Search ..... 4/480, 484

[56] References Cited

U.S. PATENT DOCUMENTS

| | | | |
|---|---|---|---|
| 2,375,907 | 5/1945 | Farmer | 4/480 X |
| 2,513,444 | 7/1950 | Barnes | 155/31 |
| 3,611,457 | 10/1971 | Wippich | 4/480 |
| 4,179,159 | 12/1979 | Sieklucki | 297/192 |
| 4,296,506 | 10/1981 | Stoute et al. | 4/480 |
| 4,428,615 | 1/1984 | Hynson | 297/118 |
| 4,550,455 | 11/1985 | Carson et al. | 4/480 |
| 4,752,293 | 6/1988 | Smith | 604/322 |
| 4,955,922 | 9/1990 | Terauchi | 4/480 |

FOREIGN PATENT DOCUMENTS

| | | | |
|---|---|---|---|
| 2229699 | 10/1990 | United Kingdom | 4/484 |

*Primary Examiner*—Charles E. Phillips
*Attorney, Agent, or Firm*—Donald P. Reynolds

[57] ABSTRACT

An incontinence seat for a wheelchair includes a seat insert attached to a wheelchair frame, the seat insert has a hole in the center. A cushion is attached to the seat insert, the cushion has a hole in the center aligned with the seat insert hole. A support bag is attached to the wheelchair frame below the seat insert. A collection bag, configured to fit through the seat insert hole and cushion hole, has a drawstring provided at a mouth of the collection bag, the bottom of the collection bag is nested inside the support bag, the inner surface of the mouth is inverted and wrapped around and under the cushion. A seat cover is affixed to the inner surface of the mouth of the collection bag, the seat cover includes a gutter flap and a seat cover hole aligned with the cushion and seat insert holes, the gutter flap is hinged to the seat cover, a deodorant pack may be affixed to the gutter flap.

17 Claims, 4 Drawing Sheets

INCONTINENCE SEAT FOR A WHEELCHAIR

BACKGROUND OF THE INVENTION

1. Field of the Invention

The present invention is a seat for a wheelchair with provision for incontinent people.

Incontinent people are unable to control their bladders or bowels in passing waste matter from the body. People with this problem are often confined to wheelchairs. Disposable undergarments are not desirable because prolonged sitting in wet disposable undergarments is uncomfortable and can cause skin rashes and pressure sores. Wheelchair commodes do the best job of keeping incontinent people separated from their waste.

U.S. Pat. No. 4,296,506 discloses a wheelchair commode in the prior art. Although the wheelchair commode disclosed in the '506 patent keeps seated occupants more separated from their waste than disposable undergarments, this wheelchair commode is still susceptible to urine seepage due to the spacing between the component parts. For example, urine seepage is common in the spacing between the cushion and the seat insert, and between the seat insert and the collection pan, and between the collection pan liner and the inside of the collection pan. Incontinent people often have impaired urine flow that consists of trickles. The trickles will seep into the spaces between the aforementioned component parts and drip onto the floor instead of into the collection pan making cleaning and sanitation difficult. Prolonged sitting on a seat covered with urine can cause skin rashes and pressure sores.

Another drawback of the wheelchair commode in U.S. Pat. No. 4,296,506 is that there is nothing preventing waste from spilling from the collection pan. Urine may spill from the pan if the wheelchair is tilted to mount a step, ramp or incline. Also, urine may spill when the chair travels over a rough surface, when the chair is suddenly accelerated or when the occupant makes a sudden movement.

Another drawback of the wheelchair commode in U.S. Pat. 4,296,506 is the noise from urine trickling into the collection pan. This noise distracts and embarrasses the occupant and all those in the immediate vicinity. The odor from the urine can also be a cause of embarrassment and low self esteem.

The wheelchair commode in U.S. Pat. No. 4,296,506 has a solid waste receptacle directly below the wheelchair seat. When occupants sit, they put pressure on the solid receptacle below the seat. This is uncomfortable and can cause the receptacle to separate from the wheelchair resulting in urine spillage and a further cause of embarrassment.

U.S. Pat. No. 4,179,159 discloses a urinary drainage bag adapted to be attached to a catheterized patient in a wheelchair. This precludes its use by incontinent patients that can not be catheterized. Permanent indwelling catheters can lead to complications including increases in urinary tract infections, kidney changes and changes in the bladder wall relating to carcinoma.

Another wheelchair commode in the prior art is disclosed in U.S. Pat. No. 4,955,922. This wheelchair commode has limited mobility and fails to provide for seated occupants who must defecate. Incontinent people with bowel control problems could not use this wheelchair commode.

The present invention is an incontinence seat for a wheelchair that eliminates or alleviates the drawbacks of the prior art devices. The incontinence seat includes a seat insert with a hole. A cushion with a hole overlies the seat insert and both holes are aligned with it. A support bag is attached to the wheelchair below the seat insert. A seat insert, cushion and support bag have been suggested in the prior art. The present invention uses somewhat similar but modified parts together with a one-piece disposable collection bag that includes an attached seat cover and deodorized gutter flap. The collection bag is configured to fit through the aligned holes in the cushion and seat insert. The bottom of the collection bag is nested within the support bag. The inner surface of the mouth of the collection bag is inverted and wrapped around the top and sides of the cushion.

It is an object of the present invention to provide an incontinence seat that provides comfortable support and spaces occupants away from their waste so that skin rashes and pressure sores are reduced or prevented.

Another object of the invention is to provide a sanitary and disposable waste collection bag that does not have to be cleaned and sanitized for each use.

A further object of the invention is to prevent seepage, spillage and the noise of trickling urine.

Another object of the present invention is to provide an incontinence seat that allows the waste collection bag to be discretely hidden.

It is a further object of the invention to provide an incontinence seat that reduces or eliminates odors.

Another object of the present invention is to provide an incontinence seat that may be easily assembled and removed from a wheelchair.

The above objectives are achieved by my incontinence seat for use in combination with a wheelchair. The incontinence seat includes a seat insert attached to a wheelchair frame. The seat insert has a hole in the center. A cushion overlies the seat insert. The cushion has a hole in the center aligned with the hole in the seat insert. A support bag is attached to the wheelchair frame below the seat insert. The support bag supports and hides the bottom of the collection bag. The collection bag has a mouth, a bottom, a conduit between the mouth and bottom, an inner surface, an outer surface, and a drawstring provided within the mouth of the collection bag. The bottom of the collection bag is configured to fit through the seat insert hole and cushion hole and is nested inside the support bag. The inner surface of the mouth of the collection bag is inverted and wrapped around the top and sides of the cushion. A seat cover is affixed to the inner surface of the mouth of the collection bag. The seat cover has a hole in the center aligned with the cushion and seat insert holes. The seat cover may be antiseptically treated. The seat cover has a gutter flap that is hinged to the seat cover. A deodorant pack may be affixed to the gutter flap. The collection bag may also be deodorized.

DETAILED DESCRIPTION OF THE INVENTION

Figure 1:
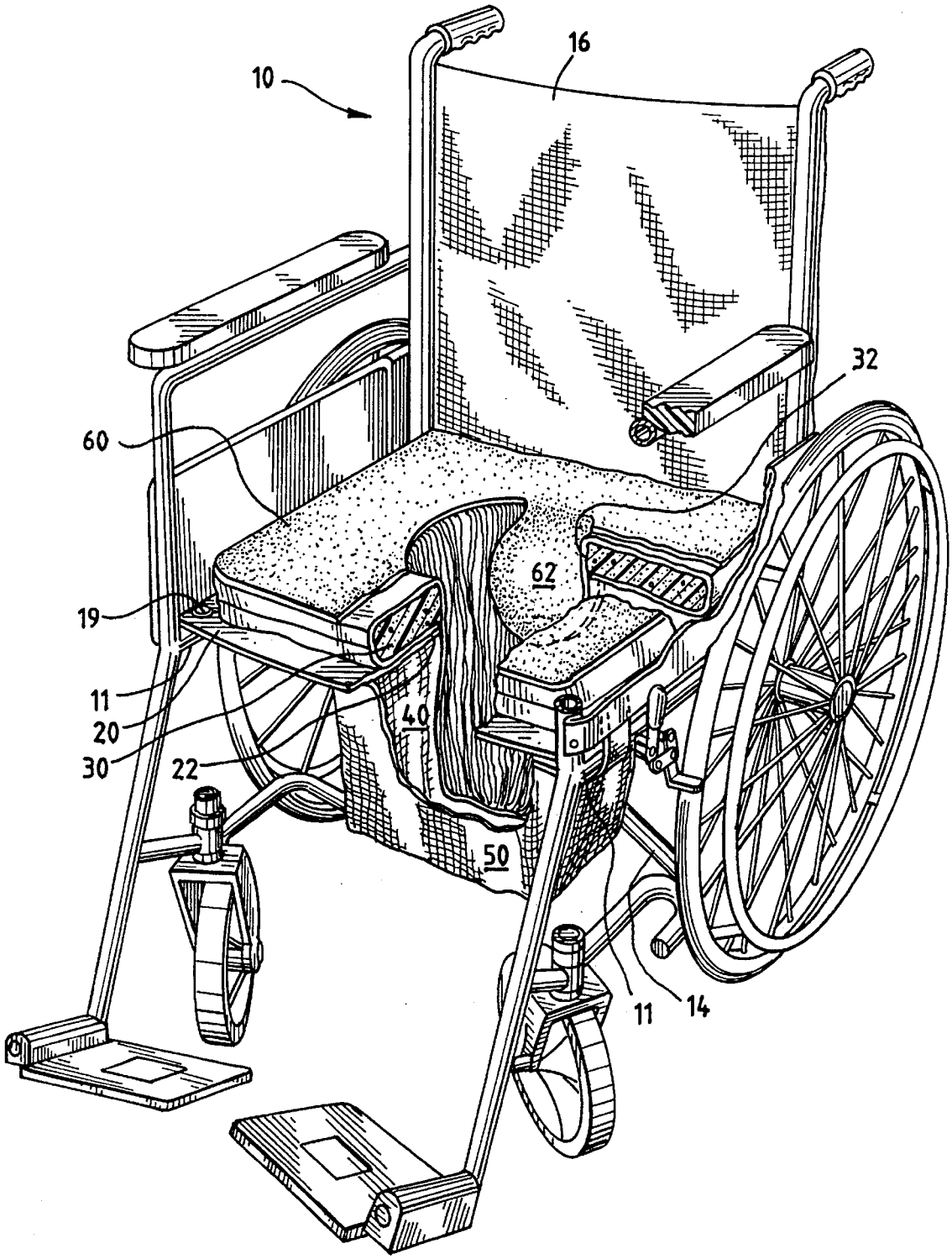
FIG. 1 is a perspective view of the preferred embodiment of the present invention in combination with a wheelchair.
Figure 2:
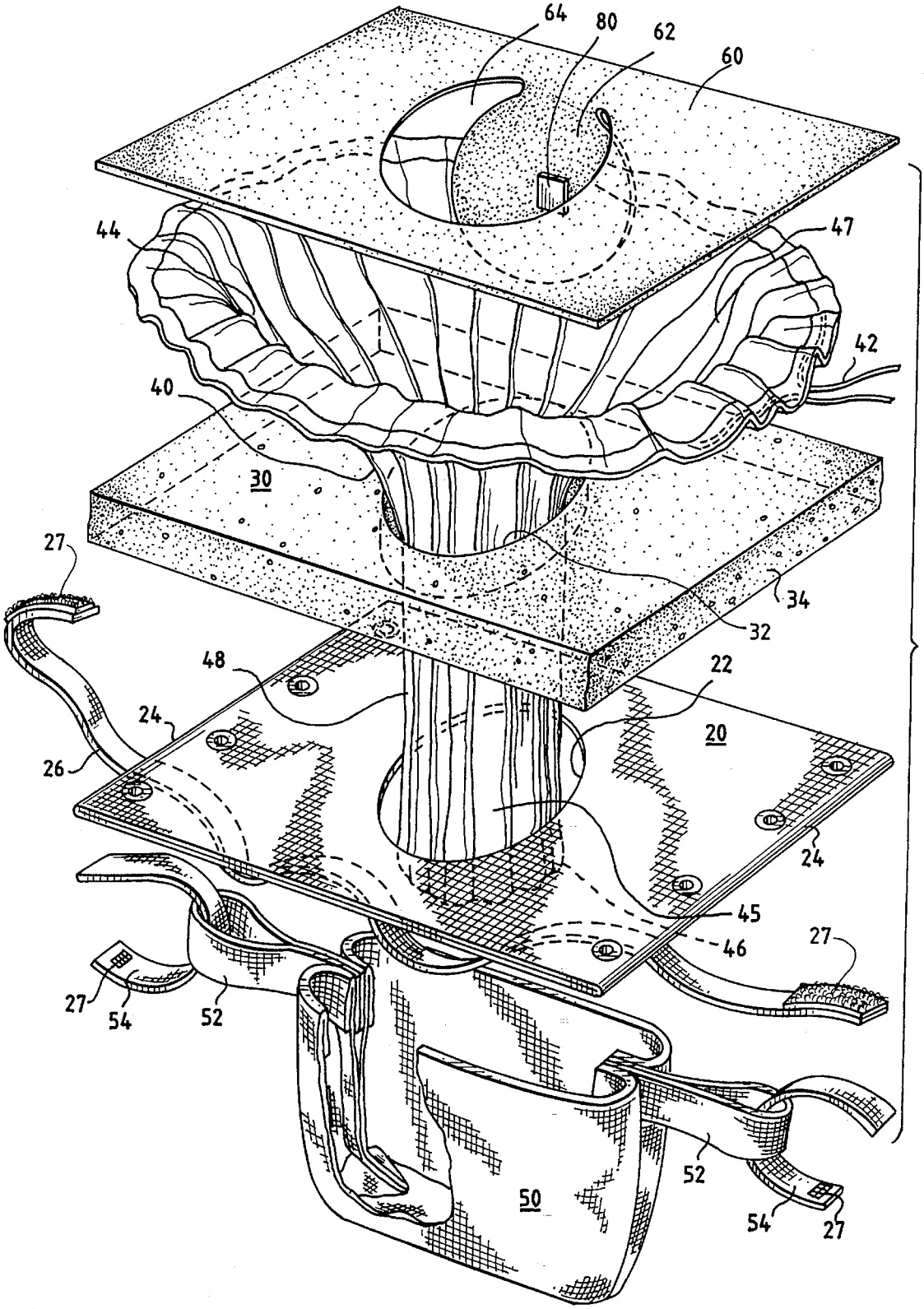
FIG. 2 is a perspective view of the preferred embodiment without a wheelchair.

FIG. 1 is a perspective view of the preferred embodiment of the present invention. FIG. 2 is a perspective view of the present invention without a wheelchair. In FIGS. 1 and 2, the invention is installed on a wheelchair 10. The invention includes a seat insert 20 attached to seat bars 11 with wheelchair fasteners 19. Screws, bolts, pins and similar fasteners 19 may be used to attach seat insert 20 to seat bars 11. Seat insert 20 has a seat insert hole 22 in the center. A cushion 30 is attached to the seat insert 20 with seat straps 26. Cushion 30 has a cushion hole 32 in the center aligned with seat insert hole 22. Referring back to FIG. 1, support bag 50, which is located below seat insert 20, is attached to seat bars 11 with support bag straps 54, not shown in FIG. 1.

In FIG. 2, a collection bag 40 includes a mouth 44, a bottom 46, a conduit 45 between mouth 44 and bottom 46, an inner surface 47, and an outer surface 48. A drawstring 42 is provided at the mouth 44 of the collection bag 40. A seat cover 60 is affixed to the inner surface 47 of the mouth 44 of the collection bag 40. Seat cover 60 includes a gutter flap 62, which is hinged to seat cover 60, and a seat cover hole 64. A deodorant pack 80 may be affixed to the gutter flap 62. The bottom 46 of the collection bag 40 is configured to fit through aligned holes 22 and 32. Bottom 46 is nested inside support bag 50. Inner surface 47 of mouth 44 is inverted and wrapped around the top and sides of cushion 30, as best seen in FIG. 1.

Seat insert 20 has a seat insert hole 22 in the center of seat insert 20. Seat insert hole 22 is preferably circular or oval. Seat insert hole 22 is big enough for both urine and feces to pass through. The seat insert 20 is constructed of a porous non-absorbent material.

Cushion 30 overlies seat insert 20 or can be secured with seat straps 26. Cushion 30 has a hole 32 in its center. Cushion hole 32 is aligned with seat insert hole 22. Like seat insert hole 22, cushion hole 32 is preferably circular or oval. Cushion hole 32 is big enough for both urine and feces to pass through. Fastening means, such as hook and loop fasteners 27, are provided at opposite ends of seat straps 26 to connect the ends of seat straps 26. Seat straps 26 are attached through aligned center hole of cushion 32 and seat insert hole 22 around corresponding sides 34 and 24, and seat bar 11 securing with fasteners 27 beneath seat insert 20. Cushion 30 is preferably made of a resilient foam material three inches thick. Cushion 30 must be thick enough to provide the necessary stiffness for seating comfort and shaped to conform to the length and width of seat insert 20. Other cushions may be used, for example gas-filled, gel-filled, liquid-filled, alone or in combination. Cushion 30 may have a washable cushion cover.

Support bag 50 is located below seat insert 20 and in front of crossbars 14. Support bag 50 may include support bag handles 54 at opposite ends of support bag 50. Support bag 50 is attached, at support bag handles 52, to seat bars 11 with support bag straps 54. Alternatively, support bag 50 may include support bag straps 54 incorporated at opposite ends therein. Support bag straps 54 are similar to seat straps 26. Support bag 50 is constructed of the same material as seat insert 20.

In FIG. 2, collection bag 40 includes mouth 44, bottom 46, conduit 45 between mouth 44 and bottom 46, inner surface 47, and outer surface 48. Drawstring 42 is provided within the mouth 44 of collection bag 40. Collection bag 40 is preferably constructed of a disposable plastic material.

A seat cover 60 is affixed to inner surface 47 of mouth 44 of the collection bag 40 at opposite ends of seat cover 60. Seat cover 60 and collection bag 40 may be affixed by tape, glue, stitching or other similar affixing means. Seat cover 60 has a seat cover hole 64 in the center of seat cover 60 effectively aligned with cushion hole 32 and seat insert hole 22. Like seat insert hole 22 and cushion hole 32, seat cover hole 64 is circular or oval. Seat cover hole 64 is big enough for both urine and feces to pass through.

A gutter flap 62 is hinged to seat cover 60. Seat cover 60 and gutter flap 62 are made of an absorbent material such as absorbent paper towels or diapers. The hinge is constructed so as to prevent seat cover 60 from absorbing urine from gutter flap 62; for example, the hinge may be perforated. A deodorant 80 may be affixed to gutter flap 62. When pushed into conduit 45, gutter flap 62 adds structure to conduit 45, helps direct waste flow toward the bottom 46 of collection bag 40, and alleviates urine trickling noise.

In use, collection bag 40 is installed by guiding the bottom 46 of collection bag 40 through cushion hole 32 and seat insert hole 22; nesting the bottom of collection bag 46 into support bag 50; inverting and wrapping inner surface 47 of mouth 44 of collection bag 40 around the top and sides of cushion 30; pushing gutter flap 62 slightly into conduit 45; and spreading deodorant 80 on gutter flap 62.

After use, collection bag 40 is easily removed by unwrapping mouth 44 of the collection bag 40 from cushion 30; closing collection bag 40 with drawstring 42; withdrawing collection bag 40 from support bag 50, seat insert 20 and cushion 30; and disposing of collection bag 40 in an appropriate container.

Figure 3:
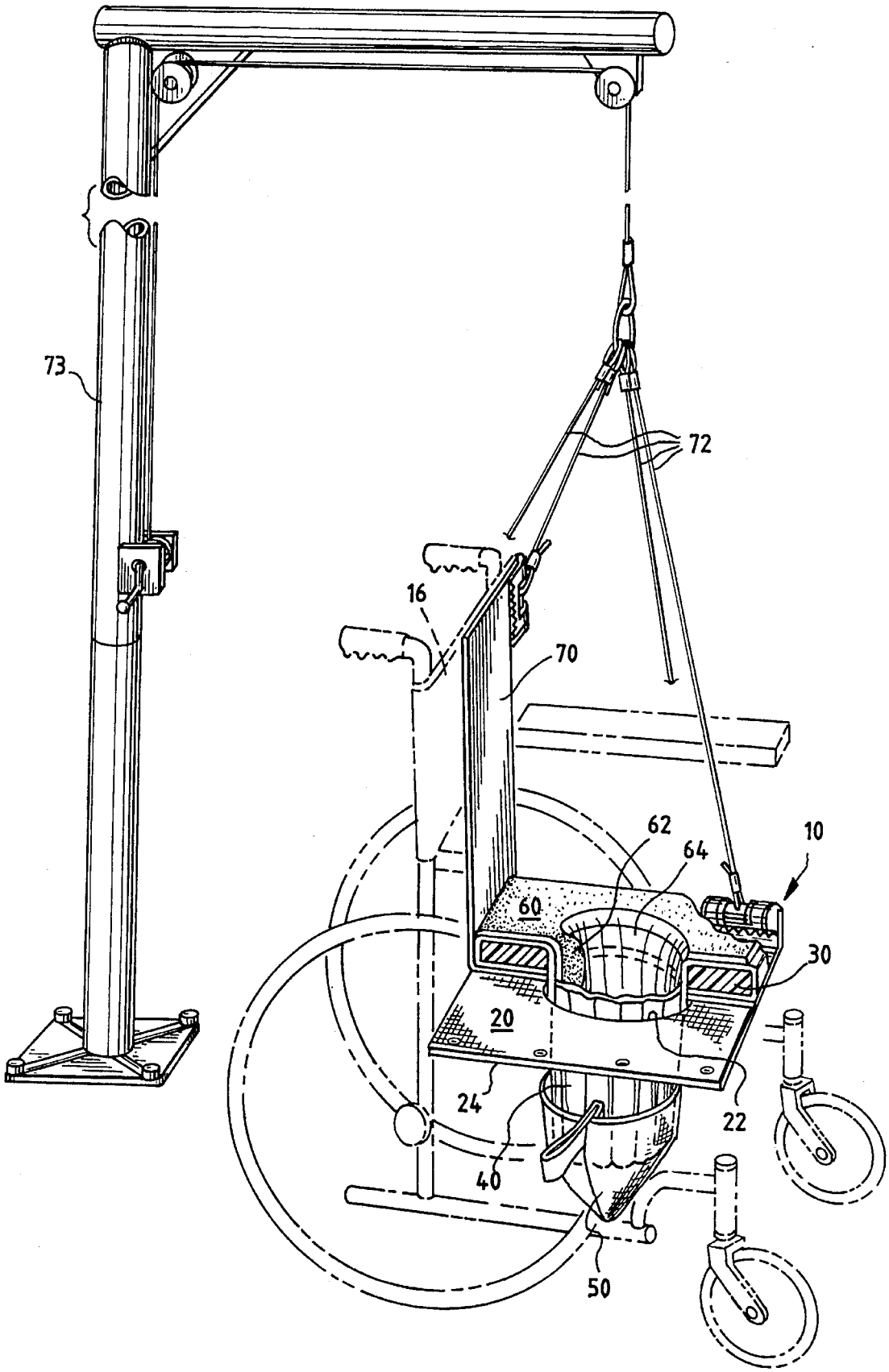
FIG. 3 is a perspective view of an alternative embodiment of the present invention in combination with a wheelchair and a hydraulic or Hoyer lifting device.
Figure 4:
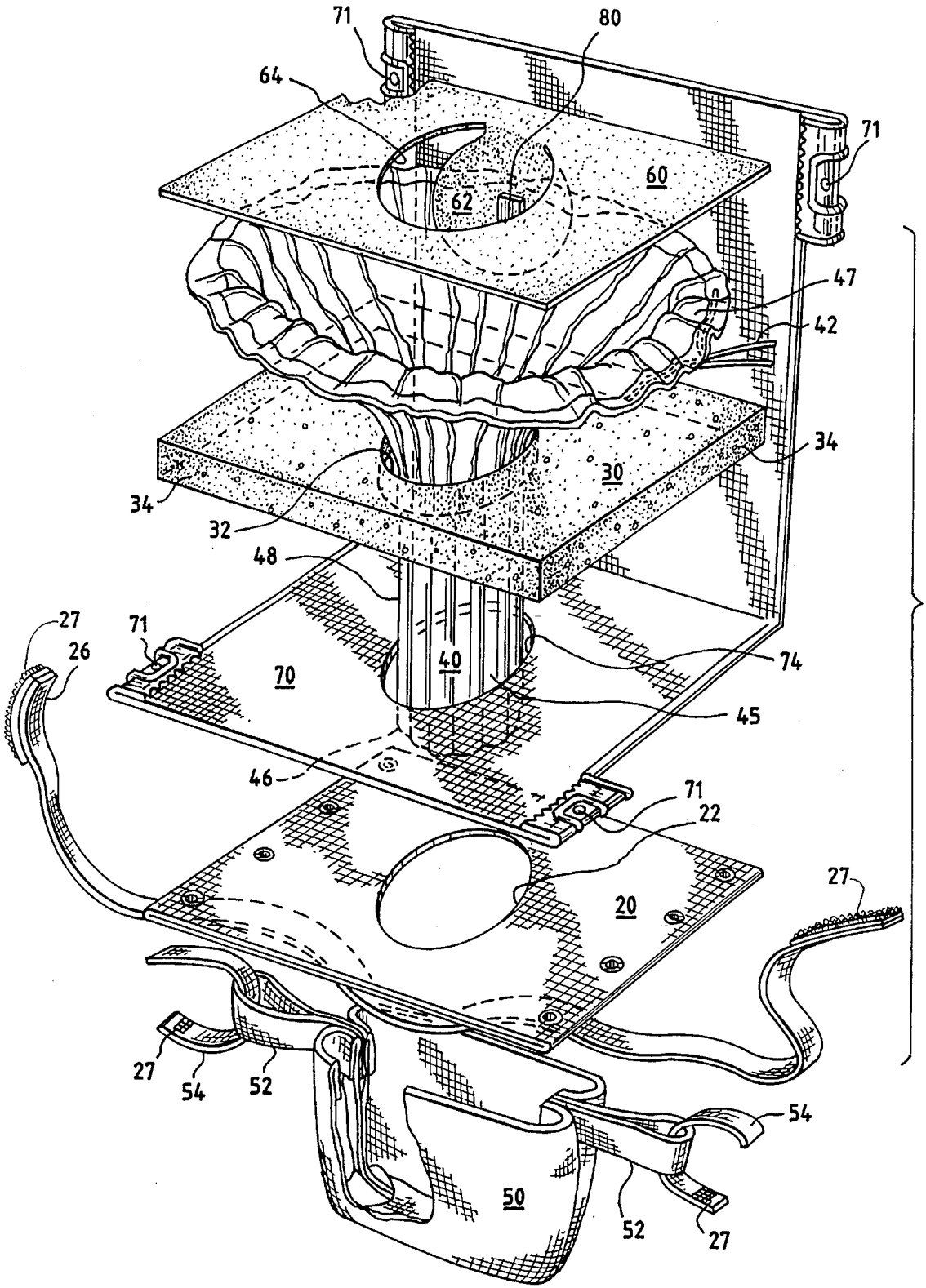
FIG. 4 is a perspective view of the alternative embodiment in FIG. 3 without a wheelchair or lifting device.

In an alternative embodiment of the invention, as best shown in FIGS. 3 and 4, a Hoyer seat 70 modified with a hole 74 is disposed between seat insert 20 and cushion 30. Generally, a Hoyer seat is used in conjunction with hydraulic or Hoyer lift 73 for transferring an incapacitated person between a bed and a wheelchair. To facilitate the reverse transfer between the chair and the bed, the incapacitated person must sit on the Hoyer seat 70 and wear diapers or a catheter. Hoyer seat 70 includes four small holes 71 at its four corners for attaching it to Hoyer lifting device 73. The modified Hoyer seat 70 has a Hoyer seat hole 74 aligned with seat insert hole 22. Hoyer seat hole 74 is preferably circular or oval. Hoyer seat hole 74 is big enough for both urine and feces to pass through. Cushion 30 overlies Hoyer seat 70 and seat insert 20. Cushion 30 has cushion hole 32 aligned with Hoyer seat hole 74 and seat insert hole 22. A collection bag 40 is installed and removed in a similar manner to that in the preferred embodiment. In use, this embodiment of the invention allows an occupant to void while sitting and during transfer on Hoyer seat 70.

In another embodiment of the invention, seat insert 20, or Hoyer seat 70, and cushion 30 are incorporated to form a cushion seat or cushion Hoyer seat, respectively. The cushion seat is attached to seat bars 11 with fasteners 19. A cushion Hoyer seat is attached to seat insert 20 with seat straps 26. Collection bag 40 is wrapped around the cushion in the cushion seat, or cushion Hoyer seat, in the same manner as in the preferred embodiment.

Because it may be desirable to measure urine volume, acidity or color, another embodiment of the invention may include a urine-measuring label, or mechanism, affixed to, or incorporated into, the bottom 46 of collection bag 40. A urine-draining mechanism may also be incorporated into the bottom 46 of collection bag 40.

The present invention may be incorporated with an electric wheelchair in the same manner as described above.

The present invention may be used on a battery-powered scooter with suitable modifications. The cushion may be shaped to match the shape of the scooter seat. However, the cushion is not required. A hole may be cut through the scooter seat. A support bag may be front mounted on top of a battery pack or rear mounted behind the battery pack. In use, the bottom of a collection bag is guided through a scooter seat hole; the bottom is nested through a support bag; and the mouth of the collection bag is wrapped and inverted around and under the scooter seat or cushion.

The present invention may be used in conjunction with a chair with suitable modifications. The seat insert may be replaced with a chair seat having a hole. The cushion would be attached to the chair seat. The support bag would be attached to the chair frame below the chair seat. The bottom of the collection bag would be configured to fit through the chair seat hole and nested inside the support bag.

Also, the present invention may be used in conjunction with a mattress with suitable modifications. The Hoyer seat and cushion may fit into a cut out area of the mattress that conforms to the length, width, and depth of the cushion. The mattress would have a hole in the center to correspond with the hole in the cushion. The support bag would be attached to a bed frame below the mattress. The bottom of the collection bag would be configured to fit through the mattress hole and nested inside the support bag.

Also, the collection bag can be used with a standard commode chair, thus eliminating the need to clean and sanitize the commode pan and seat.

Although a preferred embodiment of the invention has been disclosed in detail for illustrative purposes, it will be recognized by those with skill in the art that variations of the disclosed apparatus lie within the scope of the present invention.

Having described my invention, what I claim is:

1. An incontinence seat for use in combination with a wheelchair, the incontinence seat comprising:

a seat insert attached to the wheelchair, the seat insert having a hole;

b. a cushion attached to the seat insert, the cushion having a hole aligned with the seat insert hole;

c. a support bag attached to the wheelchair below the seat insert;

d. a collection bag having a mouth, a bottom, a conduit between the mouth and bottom, an inner surface, and an outer surface, the bottom configured to fit through the cushion hole and seat insert hole, the bottom nested inside the support bag, the inner surface of the mouth inverted and wrapped around the top and sides of the cushion; and e. a seat cover affixed to the inner surface of the mouth of the collection bag, the seat cover having a gutter flap hinged thereto and seat cover having a hole aligned with the cushion and seat holes, the gutter flap extending into the collection bag mouth.

2. The incontinence seat of claim 1 wherein the seat insert is attached to opposite seat bars of the wheelchair with wheelchair fasteners.

3. The incontinence seat of claim 1 wherein the support bag is attached to opposite seat bars by at least one hook and loop fastener strap.

4. The seat of claim 1 wherein the cushion is constructed of a resilient foam material.

5. The incontinence seat of claim 1 wherein the seat insert and support bag are constructed of a porous non-absorbent material.

6. The incontinence seat of claim 1 further including a drawstring provided at the mouth of the collection bag.

7. The incontinence seat of claim 1 wherein the seat cover is constructed of an absorbent disposable material.

8. The incontinence seat of claim 1 further including deodorant affixed to the gutter flap.

9. An incontinence seat for use in combination with a wheelchair, the incontinence seat comprising:

a seat insert attached to the wheelchair, the seat insert having a hole;

b. a cushion attached to the seat insert, the cushion having a hole aligned with the seat insert hole;

c. a supplemental seat disposed between the seat insert and cushion, the supplemental seat attached to the cushion and a seat back of the wheelchair, the supplemental seat having a hole aligned with the seat insert and cushion holes;

d. a support bag attached to the wheelchair below the seat insert;

e. a collection bag having a mouth, a bottom, a conduit between the mouth and bottom, an inner surface, and an outer surface, the bottom configured to fit through the cushion, supplemental seat and seat insert holes, the bottom nested inside the support bag, the inner surface of the mouth inverted and wrapped around and under the cushion; and f. a seat cover affixed to the inner surface of the mouth of the collection bag, the seat cover having a gutter flap hinged thereto and the seat cover having a hole aligned with the cushion, supplemental seat and seat insert holes, the gutter flap extending into the collection bag mouth.

10. The incontinence seat of claim 9 wherein the seat insert is attached to opposite seat bars of the wheelchair with wheelchair fasteners.

11. The incontinence seat of claim 9 wherein the support bag is attached to opposite seat bars of the wheelchair by at least one hook and loop fastener strap.

12. The incontinence seat of claim 9 wherein the cushion is constructed of a resilient foam material.

13. The incontinence seat of claim 10 wherein the supplemental seat, seat insert and support bag are constructed of a porous non-absorbent material.

14. The incontinence seat of claim 9 further including a drawstring provided at the mouth of the collection bag.

15. The incontinence seat of claim 9 wherein the seat cover is constructed of an absorbent disposable material.

16. The incontinence seat of claim 9 further including deodorant affixed to the gutter flap.

17. The incontinence seat of claim 9 further including a seat cover that is antiseptically treated.

* * * * *